US008419490B1

(12) United States Patent
Eason

(10) Patent No.: US 8,419,490 B1
(45) Date of Patent: Apr. 16, 2013

(54) RETRACTABLE TETHER AND DYE (RTD) COMBINED WITH A PORTABLE FLOATATION DEVICE (PFD)

(76) Inventor: Scott Eason, Robinson, TX (US)

( * ) Notice: Subject to any disclaimer, the term of this patent is extended or adjusted under 35 U.S.C. 154(b) by 0 days.

(21) Appl. No.: 13/417,245

(22) Filed: Mar. 11, 2012

Related U.S. Application Data

(63) Continuation-in-part of application No. 12/471,448, filed on May 25, 2009, now abandoned.

(51) Int. Cl.
*G01D 21/00* (2006.01)

(52) U.S. Cl.
USPC ..... 441/89; 441/80

(58) Field of Classification Search ..... 441/80, 441/84, 88, 89, 92, 93; 116/211
See application file for complete search history.

(56) References Cited

U.S. PATENT DOCUMENTS

| | | | | |
|---|---|---|---|---|
| 2,418,392 | A | 4/1947 | Bender | |
| 4,080,677 | A | 3/1978 | Koehler | |
| 4,450,179 | A * | 5/1984 | Vink et al. | 426/103 |
| D388,493 | S | 12/1997 | Summers | |
| 5,855,497 | A | 1/1999 | French | |
| 6,050,077 | A * | 4/2000 | Muller | 57/210 |
| D554,225 | S | 10/2007 | Peterson | |

* cited by examiner

*Primary Examiner* — Edwin Swinehart
(74) *Attorney, Agent, or Firm* — KB Patents; Luca D'Ottone

(57) ABSTRACT

The present application discloses a device designed to be used on board of ships, vessels, boats. The device consists of a retractable tether having two ends a first end and a second end. Said first end to be securely connected to the body of said ship. Said second end to be securely connected to a personal floatation device. Said retractable tether thus connects the seaman wearing it to the body of the ship or vessels. During normal operations the seaman can enjoy additional room to move by extending a retractable reel from a retractable reel assembly. When an out of the ordinary tension is applied as when the seaman is ejected by the ship, the tether breaks dispersing in the water an high visibility dye in the water. A portable floatation device then helps the seaman to be kept afloat while waiting for aid to come.

4 Claims, 3 Drawing Sheets

RETRACTABLE TETHER AND DYE (RTD) COMBINED WITH A PORTABLE FLOATATION DEVICE (PFD)

CROSS REFERENCE TO RELATED APPLICATIONS

This application is a Continuation In Part (CIP) Application under 37 CFR 1.53(b) of US Nonprovisional Utility patent application Ser. No. 12/471,448 by SCOTT EASON directed to a COMBINED RETRACTABLE TETHER AND DYE (RTD) PORTABLE FLOATATION DEVICE (PFD) filed on May 25, 2009 now abandoned that is hereby incorporated by reference, from which the benefit of an early application date is claimed.

STATEMENT REGARDING FEDERALLY SPONSORED RESEARCH

The formulation and development of the device of the present application took place without benefiting of any federal support.

BACKGROUND OF THE INVENTION

1. Field of the Invention

The device object of the present application is directed to a safety system for ships, boats, and floating vessels in general, and more in particular to a human lifesaving apparatus in the form of a tether or rope filled with ink or other tracer attached to a jacket that can alternative take the shape of a large belt containing an inflatable chamber which can then be utilized as a floatation device for the human in water.

2. Description of the Prior Art

Inflatable life vests have long been utilized as flotation devices for humans. There are a great many sporting activities that are engaged in by humans in conjunction with water. These water activities can prove to be unexpectedly dangerous and have been known to cause the death of the participant.

For example while sailing on a sail boat a sudden wind can twist the boat causing the user occupant to be bumped into the water. If said sudden blow of wind is strong enough not only the user can be bumped into the water but also the boat itself can be flipped over.

Despite the great efforts provided by the prior art no one measure have been sufficient to save each single sea man or sailor that fall into the water. In fact from time to time still casualty due to seaman falling at sea still occurs.

Other situations may be risky, and require the use of devices such as the one disclosed and claimed in the present invention. These situations include operations on cargo or passenger ships, operations on small vessels, or sea planes, and eventually entertainment in pools or aqua parks for kids and adults where there may be the risk of drowning for children, or otherwise disabled or incapacitated people.

Various prior art devices, including the ones disclosed in the Information Disclosure Statement (IDS) attached to the present application are designed to save lives, but seaman, and sailors still die and any improvement that could save more lives is worth careful consideration. In particular some of the casualty occurs because of lack of visibility and because of the visibility encountered to locate the person felt into the water.

SUMMARY OF THE INVENTION

The structure of the present invention is directed to a life saving device which is connects a seaman with the mother vessel by means of a tether or rope whose inside is filled with a colored dye attached to a belt or a jacket worn by the seaman. The life saving devices of the present application finds use when a seaman or a sailor is ejected from a boat or vessel. The life saving device of the present application is a combination of a personal floating device (PFD) of which it is an improvement and a dye releasing tether cable (RTD).

When the seaman wearing the belt or jaked falls into sea then the rope or tether breaks because of the tension caused by the fall thus releasing the colored dye. The seaman is kept afloat by the jacket while the ink contained in the rope spills into the water by gravity thus signaling the position of the seaman to intervening rescuers.

The primary objective of the present invention is to construct an apparatus which can save the life of a human being that fell in the water and is about ready to drown. It is a secondary objective achieved by the device of the present application to aid rescuer to locate a missing person lost at sea by spreading a colored patch of dye in the water.

Another objective of the present invention is to construct a lifesaving apparatus that is worn by a human with the apparatus being in an inactive state and, upon the human incurring a dangerous condition, the human can cause the device to be immediately activated, making it available as a personal floating device.

It is then a further objective of the present invention to provide for a devices that release a colored dye in the water when the sailor is bumped out of a boat or vessel.

It is further an objective of the present invention to provide for a belt containing the life saving devices mentioned above that in addition to function as a life saving device provides for balance and stability. Additional features and accessories of the lifesaving devices of the present invention will be disclosed in the following paragraphs of the present specification and in the claims appended therefrom.

DETAILED DESCRIPTION OF THE SHOWN EMBODIMENT

Figure 1:
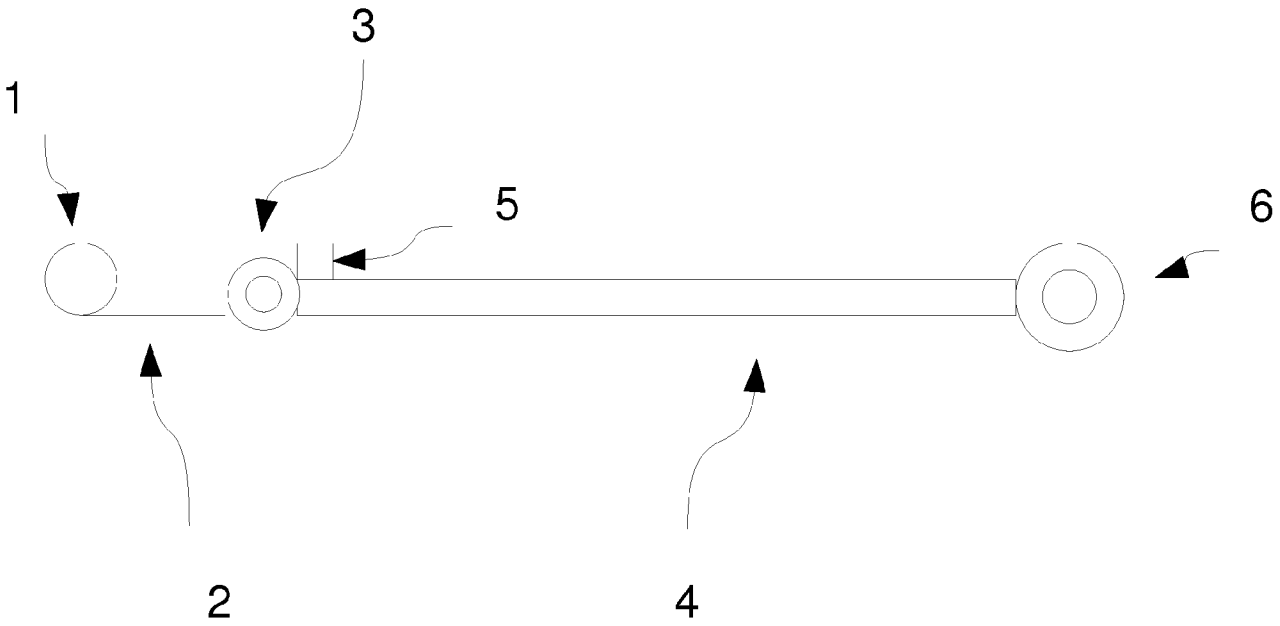
FIG. 1 is schematic view of one of the preferred embodiments of the life saving device of the present application.

Referring particularly to the drawing there is shown in FIG. 1 essential elements of the device disclosed in the present application include a reel housing assembly (1) a retractable reel (2), a first fastening means (3) such as a D shaped ring/u-bolt as discussed in §0212, an dye containing tether (4), a refill opening (5), a second fastening means (6) such as a D shaped ring/u-bolt as discussed in §0212, and a portable floatation device (PFD) not shown in the drawings.

Figure 2:
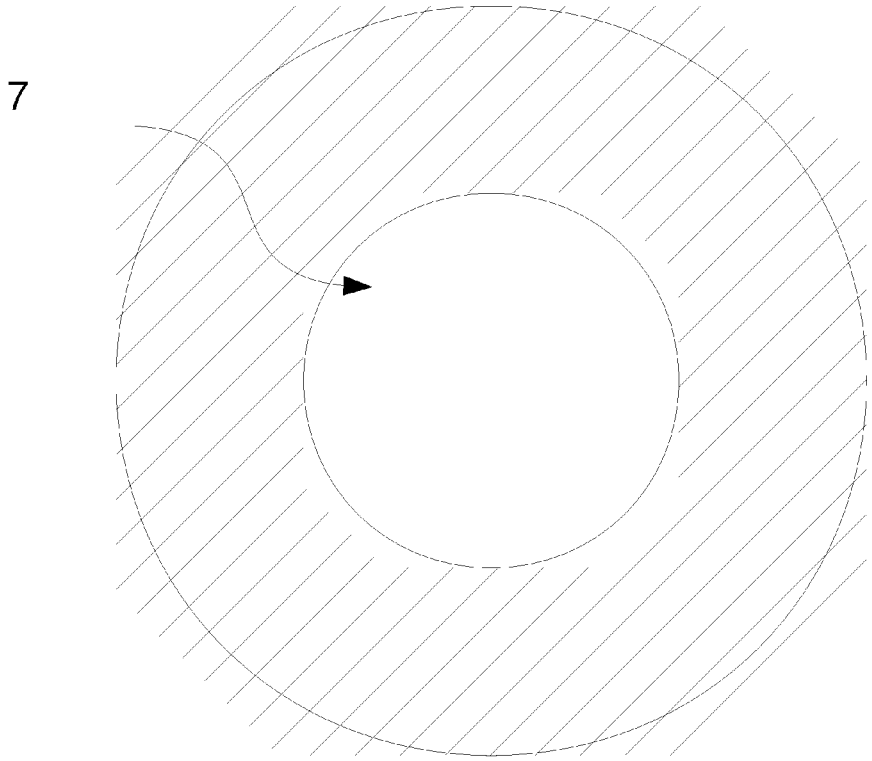
FIG. 2 is a cross section view of one of the tether portion of one of the preferred embodiments of the life saving device of the present application.

A reel assembly stores a retractable reel, that is in turn connected via a first fastening means to a tether, or rope featuring an empty cavity (7) on the inside as shown in FIG. 2. Said empty cavity is filled with an ink, paint, or more in general with a dye having a low surface tension. The empty cavity is fillable with a liquid trough refill opening (5) from time to time.

During normal on board operations the seaman wears a PFD and attaches the PFD to the RTD via said second fastening means (6). The seaman can work within the range of the tether with no additional movements or operations. If a wider range is needed the seaman can move to farther distances and a portion of the retractable reel is then dispensed from the reel housing assembly to allow for more distance. The retractable reel is them restored inside the retractable reel assembly when the seaman gets back close to the assembly.

Upon being ejected from the vessel a tension is produced by the reel extending more than its available length. When this tension is applied to the dye containing tether the tether breaks thus releasing by gravity onto the water a colored dye. While both said first and second fastening means are in fact designed to sustain pressures in excess of the one of the human body, said dye containing tether is made or rubber, or other equivalent plastic material that features a lower tensile strength than the other components of the disclosed device.

Various dyes with low surface tension and highly visible colors are used to fill out the inside cavity of the dye containing tether of the present application such as red, orange, or international orange, fluorescent yellow and/or other colors that may be seen easily from far away distances.

The inventive device of the present application consists a tether, rope, or tube, made or rubber, or plastic material, to be used on ships to secure a seaman to the body of the ship comprising a tube having two ends a first end and a second end, featuring an inside empty cavity filled with a colored dye, said first end connected to the body of the ship via a fastening means, said second end to connected to a portable floatation device to be worn by the seaman via a fastening means.

In addition to that said life saving device is connected via a tether cable to a boat or to the ground. The connecting cable has two ends. Both ends are hinged by holding devices (3) and (6) such as hooks or bolts that will be described in greater detail later. The first end of this tether cable is attached to the vest and the second one is attached to some firm support such as a ship of as said the ground. Said connecting cable is referred as to a tether in the industry and it will be referred only as a tether from now on in this application.

Figure 3:
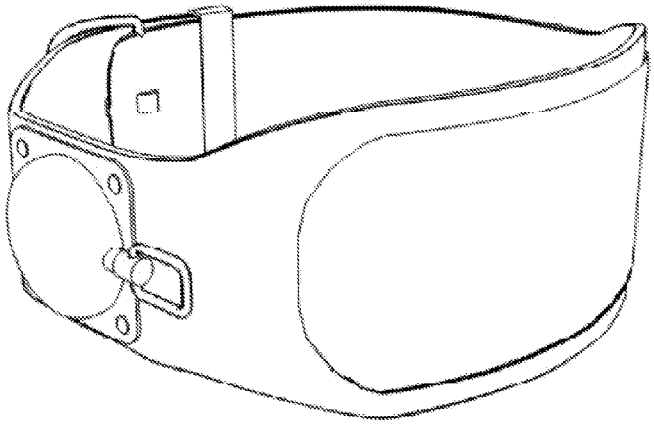
FIG. 3 is a perspective rear view of one of the preferred embodiments of the life saving device of the present application.

A tether attaches to the described PDF on a D shaped ring/u-bolt centered on back or on lower right side of said belt as shown in detail in FIG. 3. In one of the preferred embodiments of the present invention the dimensions of said D shaped ring bolt/u-bolt are one fourth inch by three fourths by two and a half inches. Tether attaches to either vest or belt with three-eighths inch quick link. Said tether attaches to belt PFD at said D shaped ring/u-bolt centered on back.

In a separate preferred embodiment of the present invention the tether is combined with a retractable reel, stored into a retractable reel assembly secured to the body of the ship, attached to said first end.

Colored dyes stored inside said empty cavity include red, orange, international orange, and fluorescent yellow. In general said colored dyes are dissolved in a liquid that has a surface tension, and a density lower than water. Examples of these solvents include Propanol, Polyethylen glycol, n-Octane, n-Propylbenzene, acetone, n-hexane, Pyridine, Tetrahydrofuran (THF), and others.

The tensile strength of the tether itself is lower than the tensile strength of the other components of the device, thus breaking when a substantial tension, comparable with the one of a seaman being ejected out of board is applied. Human body mass ranges in general between 50 to 125 Kg. A tension within that range is sufficient to cause the fracture of the tether. Special tether with lower breaking tension are designed for kids and pets. The tether is generally made of rubber or polymeric plastic material impermeable to water and most solvent. In a separate preferred embodiment of the device of the present application is internally coated with an inert compound such as paraffin, or TEFLON. TEFLON is a TRADEMARK registered with the USPTO directed to various classes of goods belonging to the du Pont de Nemours and Company a Delaware Corporation and will not be used in a negative or disparaging way in the course of the present application.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed.

I claim:

1. A tether device to be used on ships to secure a seaman to the body of the ship comprising of a tube having two ends a first end and a second end, featuring an inside empty cavity filled with a colored dye, said first end connected to the body of the ship via a D shaped ring/u-bolt, said second end connected to a portable floatation device to be worn by the seaman via a D shaped ring/u-bolt.

2. The tether device of claim one where said colored dye is selected from the group consisting of red, international orange, and fluorescent yellow.

3. The tether device of claim one where said colored dye is dissolved in a liquid that has a surface tension lower than water.

4. The tether device of claim one where said colored dye is dissolved in a solvent selected from the group consisting of Propanol, Polyethylen glycol, and n-Propylbenzene.

* * * * *